United States Patent [19]

Klint

[11] 3,959,921

[45] June 1, 1976

[54] TOY VEHICLE WITH OPERATOR-SIMULATING DOLL

[75] Inventor: Bernard C. Klint, Rockford, Ill.

[73] Assignee: Nylint Corporation, Rockford, Ill.

[22] Filed: Dec. 4, 1974

[21] Appl. No.: 529,386

[52] U.S. Cl. ..... 46/202; 46/214; 46/222

[51] Int. Cl.[2] ..... A63H 11/10

[58] Field of Search ..... 46/97, 101, 106, 116, 46/201, 202, 117, 222, 223, 221, 214

[56] References Cited

UNITED STATES PATENTS

| | | | |
|---|---|---|---|
| 2,749,661 | 6/1956 | Weissbrodt | 46/223 X |
| 2,916,851 | 12/1959 | Groschen | 46/222 |
| 3,000,137 | 9/1961 | Vine | 46/202 |
| 3,083,501 | 4/1963 | Balthazor | 46/223 |
| 3,553,887 | 1/1971 | Linstead | 46/223 |
| 3,701,217 | 10/1972 | Jensen | 46/222 |

*Primary Examiner*—Louis G. Mancene
*Assistant Examiner*—Jack Q. Lever
*Attorney, Agent, or Firm*—Wolfe, Hubbard, Leydig, Voit & Osann, Ltd.

[57] ABSTRACT

An operator-simulating doll is seated within a sunken operator's compartment in the cab of a toy truck and normally is enclosed by a windowed cupola which may be swung about a hinge to an open position to enable a child to remove the doll from the compartment.

5 Claims, 4 Drawing Figures

TOY VEHICLE WITH OPERATOR-SIMULATING DOLL

BACKGROUND OF THE INVENTION

This invention relates to a toy vehicle and, more particularly, to a toy vehicle of the type in which an operator-simulating doll is seated in a sunken operator's compartment in the top of the vehicle cab.

SUMMARY OF THE INVENTION

The general aim of the present invention is to provide a unique toy vehicle having a windowed cupola which normally covers the operator's compartment and encloses the doll but which may be easily swung about a hinge to an open position to uncover the compartment and enable removal of the doll from the compartment.

A further object is to mount the cupola for swinging about an axis which is oriented so as to prevent a child's fingers from being pinched between the vehicle and the uppermost side of the cupola regardless of whether the cupla is in its open or closed positions.

The invention also resides in the relatively simple construction of the cupola hinge and of a snap-fitting latch for releasably holding the cupola in its closed position.

These and other objects and advantages of the invention will become more apparent from the following detailed description when taken in conjunction with the accompanying drawings.

DETAILED DESCRIPTION OF THE PREFERRED EMBODIMENT

Figure 1:
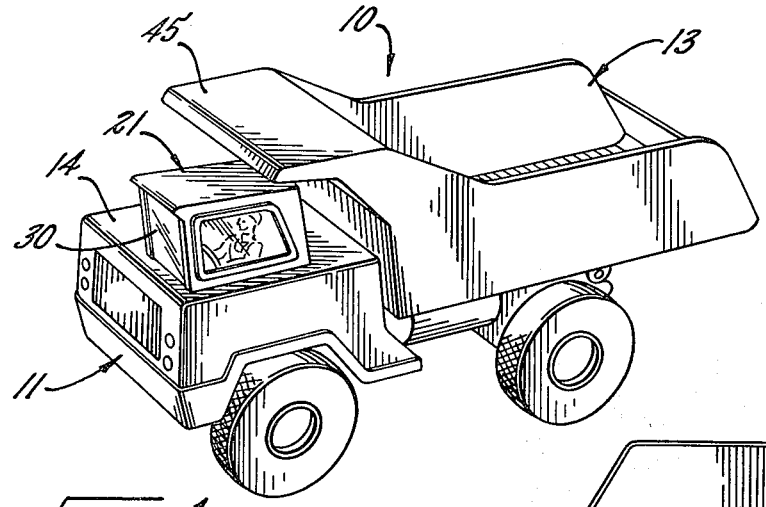
FIG. 1 is a perspective view of an exemplary toy vehicle having a new and improved cupola embodying the unique features of the present invention.

As shown in the drawings for purposes of illustration, the invention is embodied generally in a toy vehicle and specifically in a toy dump truck 10 having a forward cab 11 and a rear dump bed 13, the latter being adapted to swing between raised and lowered positions. The truck generally simulates those used in heavy earthmoving operations.

The cab 11 is made of heavy gauge sheet metal and includes a substantially horizontal top 14 (FIG. 2) having a rectangular hole 15 formed therethrough. A generally dish-shaped plastic insert 16 is fitted into the hole and defines an upwardly opening cavity which forms a sunken operator's compartment 17 having a steering wheel 19 and other controls. An operator-simulating doll 20 is seated removably in the compartment 17 and is positioned with its head and upper torso projecting upwardly from the top 14 of the cab.

In accordance with the present invention, the operator's compartment 17 is normally covered by a windowed cupola 21 which encloses the doll 20 while permitting the doll to be seen from the outside of the cupla, the cupola advantageously being mounted on the cab 11 by a hinge 23 (FIGS. 3 and 4) which enabes the cupola to be swung to an open position uncovering the compartment and the doll and permitting a child to take the doll out of the compartment. Herein, the cupola 21 comprises a box-like shroud 24 of rectangular cross-section and having an open lower end. The shroud is made of sheet metal and is sized to telescope over the upper end portion of the plastic insert 16 when the cupola is in its closed position. Generally rectangular openings 25 (FIG. 2) are formed in the front wall 26, the rear wall 27 and the normally laterally facing side walls 28 and 29 of the shroud and define window openings through which the doll 20 may be seen. Preferably, a transparent plastic box 30 (FIG. 3) having an open top and bottom is telescoped into the shroud to close off the openings and to provide glass-like windows.

To mount the cupola 21 for swinging between its positions, the hinge 23 includes a rounded tubular curl 31 (FIG. 4) which is formed integrally with the lower edge of the side wall 29. The curl 31 is fitted into an elongated opening or slit 33 formed in the top 14 of the cab 11 adjacent the compartment 17, the bottom of the slit being closed by an upwardly concave seat 34 formed from the metal struck out of the top. A hinge pin 35 is telescoped rotatably into the curl and its ends extend beyond the ends of the slit and engage downwardly concave dimples 36 formed in the underside of the top. Such engagement prevents upward movement of the hinge parts while engagement of the curl 31 with the seat 34 prevents the hinge parts from shifting downwardly.

Figure 2:
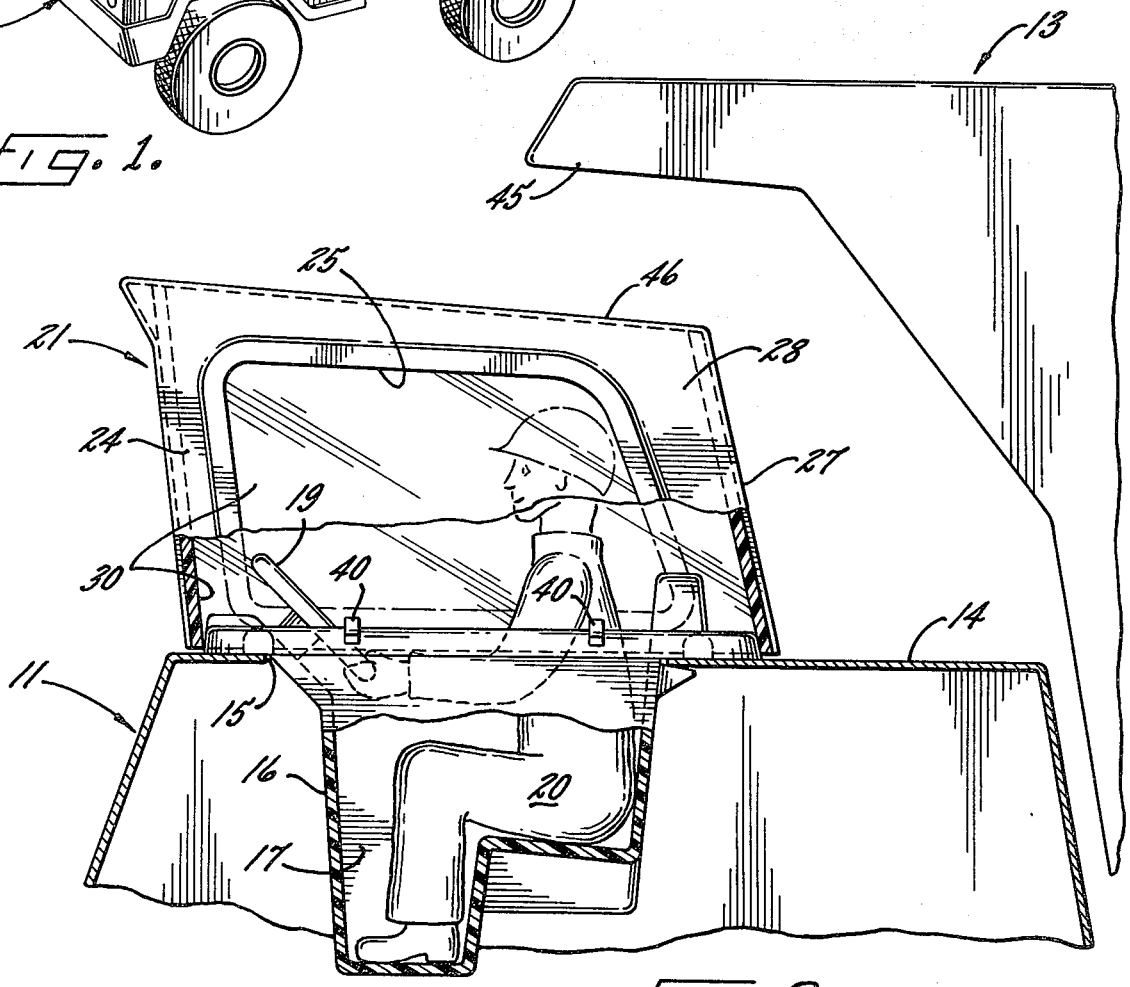
FIG. 2 is an enlarged side elevational view of a portion of the vehicle illustrated in FIG. 1, certain parts of the vehicle being broken away and shown in cross-section.
Figure 3:
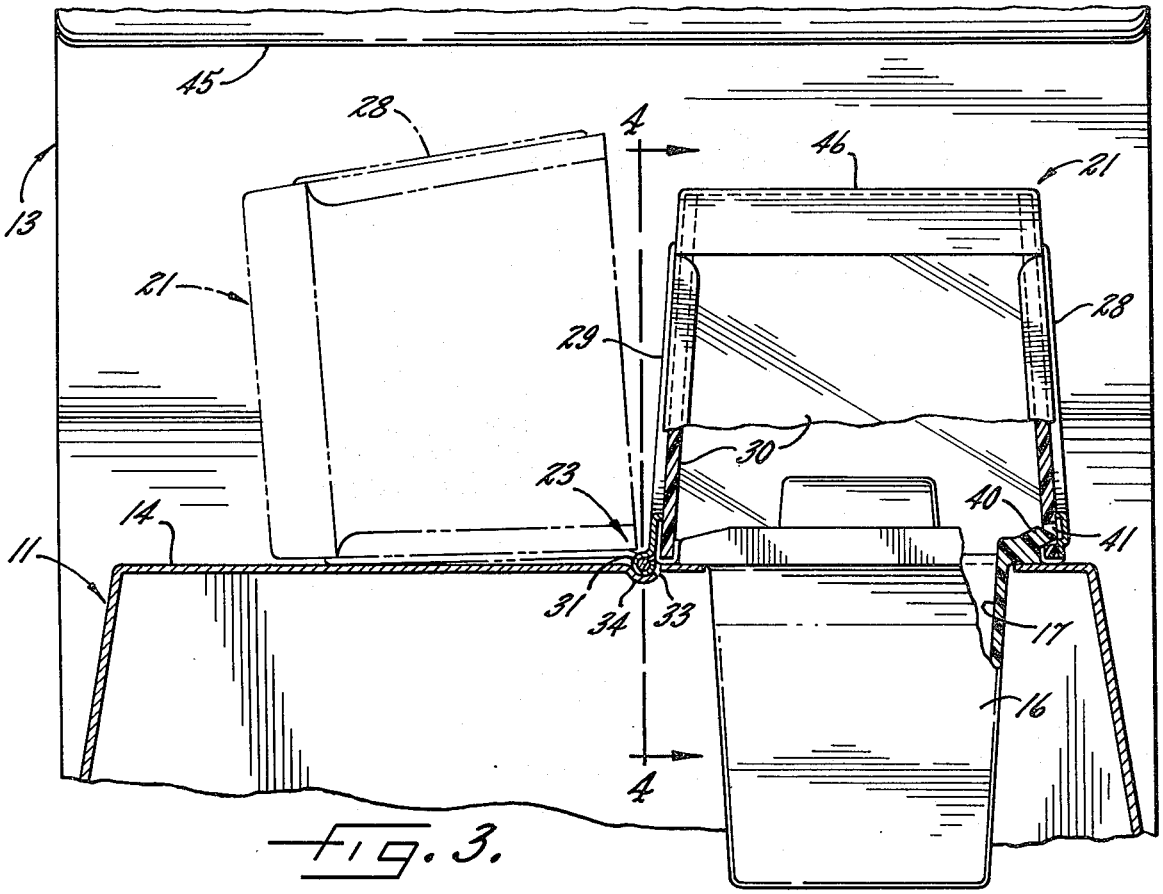
FIG. 3 is a front elevational view of the vehicle illustrated in FIG. 2, parts of the vehicle again being broken away and shown in cross-section.
Figure 4:
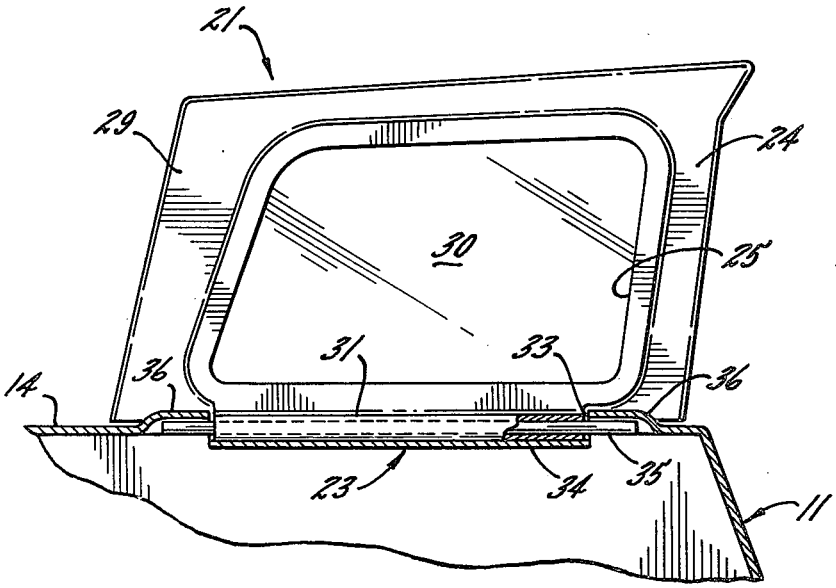
FIG. 4 is a cross-sectional view taken substantially along the line 4—4 of FIG. 3.

By grasping the side walls 28 and 29 of the cupola 21 between his thumb and fingers, a child may swing the cupola counterclockwise from the closed position shown in full in FIG. 3 to the open position shown in phantom and thus may uncover the compartment 17 and the doll 20 to enable removal of the doll from the compartment. When the child returns the cupola to the closed position, a snapfitting latch automatically engages to hold the cupola releasably in its closed position. Herein, the latch comprises a pair of laterally projecting lugs 40 (FIGs. 2 and 3) which are molded integrally with that margin of the plastic insert 16 that is located opposite of the hinge 23. As the cupola is swung to its closed position, the lower edge of the plastic box 30 cams past the lugs 40. With continued swinging of the cupola, the lugs snap into holes 41 (FIG. 3) formed in the side of the box 30 and engage the lower edges of the holes to hold the cupola in its closed position. The lugs are automatically cammed out of the holes when the child first swings the cupola toward its open position.

As shown in FIG. 2, the bed 13 of the truck 10 includes a forwardly projecting shield 45 which overlies the roof 46 of the cupola 21 when the bed is in its lowered position and the cupola is closed. In an actual truck, a similar shield guards the roof of the cupola to avoid the danger of large boulders or the like crashing through the roof when the boulders are loaded into the truck. As shown, the shield 45 is spaced upwardly from the roof 46 by a distance greater than the thickness of a child's hand. Thus, the child's hand will not be pinched between the shield and the roof if the child should happen to lower the bed and then sit upon the bed while his hand is resting on the roof.

Importantly, the cupola 21 is mounted to swing to its open position about an axis which parallels the longitudinal axis of the truck 10, and is dimensioned so as to prevent a child's hand from becoming pinched between the shield 45 and the cupola when the latter is open. As shown in phantom in FIG. 3, the normally laterally facing side wall 28 becomes the uppermost wall of the cupola when the cupola is in its open position. The vertical spacing between such wall and the shield 45 also is greater than the thickness of a child's hand so as to reduce the danger of pinching. If a cupola of similar fore-and-aft length and positioning were hinged at its rear margin rather than its side margin, the child's hand could become pinched between the shield and the uppermost wall during lowering of the bed with the cupola in an open position.

I claim as my invention:

1. A toy vehicle having a cab with a generally horizontal top, a cavity opening upwardly from the top of said cab and defining a sunken operator's compartment, an operator-simulating doll seated removably in said compartment with its head extending upwardly beyond the top of said cab, a box-like cupola normally disposed in a closed position covering said compartment and enclosing said doll, the sides of said cupola having windows rigidly carried by the cupola to permit said doll to be seen from outside of the cupola, and a generally horizontal hinge between one lower edge of said cupola and the top of said cab and mounting said cupola for bodily swinging through approximately ninety degrees to an open position uncovering said doll and said compartment to enable the doll to be removed from the compartment.

2. A toy vehicle as defined in claim 1 in which said cupola and said cab are made of sheet metal, said hinge comprising a rounded curl formed integrally with said one lower edge of said cupola, an opening formed in the top of said cab and receiving said curl, an upwardly concave seat formed integrally with the top of said cab and covering the bottom of said opening, said seat rotatably supporting said curl, and a hinge pin telescoped into said curl and extending beyond the ends of said opening and into engagement with the underside of the top of said cab.

3. A toy vehicle as defined in claim 1 in which said hinge extends generally parallel to the longitudinal axis of said vehicle.

4. A toy vehicle as defined in claim 1 further including snap-fitting latch means acting between the opposite lower edge of said cupola and the top of said cab and releasably holding said cupola in said closed position.

5. A toy vehicle as defined in claim 1 in which a dump bed is located adjacent the rear end of said cab to swing between raised and lowered positions, the forward end of said bed carrying a protective shield which overlies the roof of said cupola when said bed is in said lowered position and said cupola is in said closed position, said shield, when overlying the closed cupola, being spaced upwardly from said roof by a distance greater than the thickness of a child's hand thereby to avoid pinching of the hand between said shield and said roof when said cupola is in said closed position and said bed is swung to said lowered position, said hinge extending generally parallel to the longitudinal axis of the vehicle whereby one of the normally laterally facing sides of the cupola defines the uppermost side of the cupola when the latter is in said open position, and said shield, when overlying the open cupola, being spaced upwardly from said one side by a distance greater than the thickness of a child's hand thereby to avoid pinching of the hand between said shield and said one side when said cupola is in said open position and said bed is swung to said lowered position.

* * * * *